US006271743B1

(12) United States Patent
Müller et al.

(10) Patent No.: US 6,271,743 B1
(45) **Date of Patent: *Aug. 7, 2001**

(54) WINDING ARRANGEMENT OF A COIL

(75) Inventors: Walter Müller, Schwabach; Gerhard Döll, deceased, late of Nurnberg, by Helga Luise Friederrike Döll, Rüdiger Günther Döll, Achim Vitus Döll, Heirs; Erwin Hager, Seukendorf, all of (DE)

(73) Assignee: Siemens Aktiengesellschaft, Munich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/084,064

(22) Filed: May 22, 1998

Related U.S. Application Data

(62) Division of application No. 08/256,458, filed on Nov. 7, 1994, now Pat. No. 5,764,122.

(51) Int. Cl.[7] ..... H01F 27/30; H01F 27/28

(52) U.S. Cl. ..... 336/187; 336/186; 336/185

(58) Field of Search ..... 336/69, 70, 186, 336/187, 185

(56) References Cited

U.S. PATENT DOCUMENTS

| | | | | |
|---|---|---|---|---|
| 2,453,552 | * | 11/1948 | Stearn | 336/70 |
| 3,221,282 | * | 11/1965 | Brierley et al. | 336/69 |
| 3,246,270 | * | 4/1966 | Stein | 336/187 |
| 3,252,117 | * | 5/1966 | Fischer | 336/187 |
| 3,387,243 | * | 6/1968 | Carpenter et al. | 336/70 |
| 3,528,046 | * | 9/1970 | Sauer | 336/70 |
| 3,569,883 | * | 3/1971 | Van Nice | 336/70 |
| 3,925,743 | * | 12/1975 | Van Nice | 336/187 |
| 4,295,071 | * | 10/1981 | Kaspar | 336/187 |

* cited by examiner

*Primary Examiner*—Michael L. Gellner
*Assistant Examiner*—Anh Mai
(74) *Attorney, Agent, or Firm*—Kenyon & Kenyon

(57) ABSTRACT

To simplify coil production, in particular coils used for high-voltage transformers, a conductor is wound on to a winding form. The conductor comprises a plurality of conductor portions. The conductor portions overlap one another partially and are insulated from one another. A conductor and a winding arrangement can be produce with this method.

7 Claims, 2 Drawing Sheets

WINDING ARRANGEMENT OF A COIL

This application is a division of application Ser. No. 08/256,458, filed on Nov. 7, 1994 now U.S. Pat. No. 5,764,122.

BACKGROUND OF THE INVENTION

The present invention relates to a method for producing a winding arrangement of a coil, to an electric conductor for use with the method and to a winding arrangement produced according to the method.

Winding an electric conductor onto a coil form is a known method of producing a coil, for example, a coil for a transformer. With regard to wired-up winding arrangements, successively winding individual part windings is necessary. The part windings are subsequently wired up to one another. A special type of wired-up winding arrangement is the so-called continuous turn-over winding. Unfortunately, producing a coil having such a winding is very expensive.

The German Patent Publication DE-A1-3214171 discusses such a winding arrangement. The conductor used comprises subconductors which are connected in parallel and series.

The object of the present invention is to specify a method which simplifies the production of a coil. A further object is to provide an electric conductor for use in such a method and to specify the winding arrangement produced according to the method.

SUMMARY OF THE INVENTION

The method of present invention achieves the aforementioned object by joining a plurality of conductor portions such that they at least partially overlap one another but are insulated against one another to form a conductor and winding the conductor. A substantial time saving is achieved by producing a coil in this way. The coil can be wound substantially more quickly by the method of the present invention than heretofore. This is particularly true when a conductor is used in which additional measures, which were heretofore carried out during the winding operation, are performed before the winding operation. This relates, for example, to the insertion of separators for an insulation between windings or an edge protector. The method of the present invention is also suitable for interleaved windings.

In a preferred embodiment of the present invention, at least a part of the conductor is wound onto a winding form with the formation of a disk winding. Particularly large savings in fabrication are possible here, since at least two disk coils are produced during the winding operation. If more than 2 conductor portions overlap in a section of the conductor, a plurality of turns can be produced simultaneously in one rotation of the winding.

A continuous turn-over (i.e., continuously wound) winding step can advantageously follow. In this case, electrically connecting the ends of mutually overlapping conductor portions to one another in a further step is preferred. This eliminates a subsequent step of cutting the conductors to length. As a result, the risk of damage to the already finished winding is reduced. Clean junctions are produced on the coil.

The present invention achieves the aforementioned object of providing a conductor for use in the method by using an electric conductor comprising a plurality of conductor portions, the conductor portions being joined to one another in a partially overlapping manner but insulated from one another. This provides a type of prefabricated conductor which can be processed particularly simply and quickly. The winding time for a coil can thus be reduced depending on the number of parallel conductor portions.

The respective conductor portions can comprise, in this case, a plurality of conductor cores connected in parallel. The conductor portions can also be constructed as transposed conductors. The conductor is therefore also suitable for applications in the energy field, for example for high-voltage transformers.

In a preferred embodiment of the present invention, in each case, two mutually overlapping ends of two conductor portions are constructed to be capable of being electrically connected to one another. The subsequent step of wiring-up the conductor when the coil is finished is particularly facilitated in this way. A subsequent step of adjusting the conductor or cutting the conductor to length is superfluous, or is at least simplified. The joints are thus precisely prescribed.

In a preferred embodiment of the present invention, the conductor portions are separated from one another with spacer inserts. This eliminates the heretofore customary expensive intermediate step of winding of spacer inserts or edge protector rings when winding the transformer. This is particularly true, for the internal region of a coil.

The winding arrangement of the present invention comprises an electric conductor including a plurality of conductor portions. The conductor portions are joined to one another such that they at least partially overlap one another but are insulated from one another. Such a winding arrangement is distinguished by its small boundary dimensions, since the coil can be wound in a substantially more compact manner than heretofore. Moreover, the winding arrangement of the present invention is simpler and quicker to produce.

DETAILED DESCRIPTION

Figure 1:
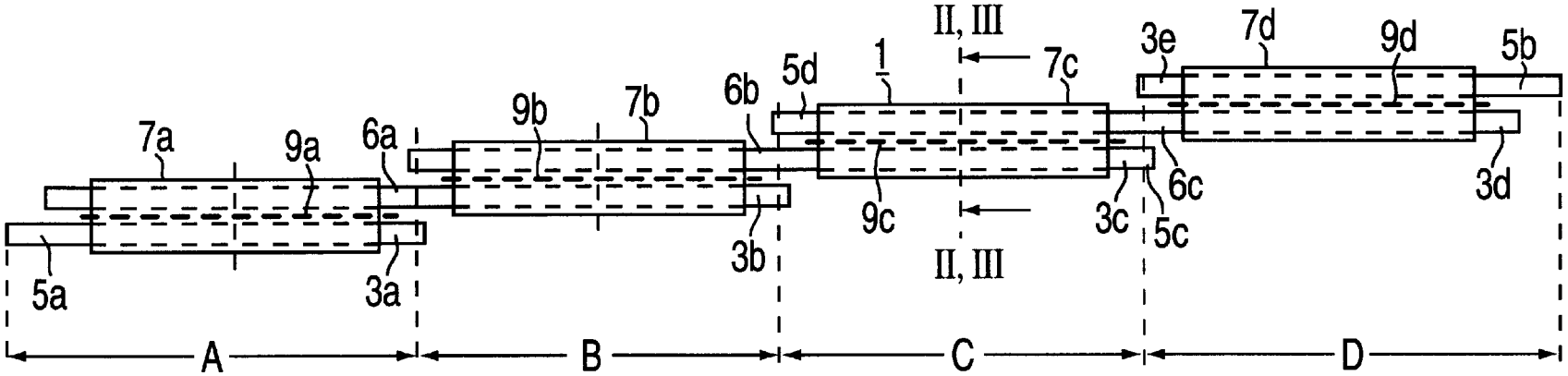
FIG. 1 shows a conductor of the present invention.

FIG. 1 shows an electric conductor 1 for a winding arrangement. The electric conductor 1 comprises a plurality of conductor portions 3*a* to 3*e*. The conductor portions 3*a* to 3*e* are mechanically coupled with one another, at least partially overlapping, but insulated with respect to one another, so that a type of prefabricated conductor is produced. The lengths of the conductor portions 3*a* to 3*e* are prescribed such that, when a coil is wound, conductor sections A to D are assigned to respectively prescribed turns. In this case, the free ends of the conductor portions 3*a* to 3*e* are, if required, dimensioned such that these portions can be electrically connected to one another after winding. This may be shown in the present FIG. 1, for example, with the aid of the free ends 5*c* and 5*d* of the conductor portions 3*c*, 3*d*. If the latter are connected to one another, the conductor 1 is electrically conducted along the conductor sections B, C and D. Transitions between the conductor sections A to D are denoted by the reference symbols 6*a*, 6*b*, 6*c*. The free ends 5*a*, 5*b* of the end-side conductor portions 3*a*, 3*e* form the external terminals of the later winding arrangement. Arranging more than two conductor portions in parallel in a section is also possible.

Figure 2:
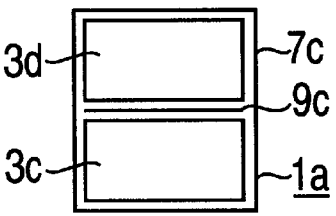
FIG. 2 shows the conductor of FIG. 1 in the cross-section along the line II—II.

The cross-section, shown in FIG. 2, of the conductor 1 from FIG. 1 along the line II—II represents a simple alternative embodiment. The conductor denoted by 1*a* has two conductor portions 3*c*, 3*d*, which are mutually insulated by the separator 9*c*. The conductor portions 3*c*, 3*d* are surrounded by a common insulation 7*c*. The conductor portions 3*c*, 3*d* can comprise one or more conductor cores, for example as a solid conductor or a transposed conductor. This embodiment of the electric conductor is particularly space saving, since a very closely and compactly wound coil which has very small boundary dimensions can be produced from it.

Figure 3:
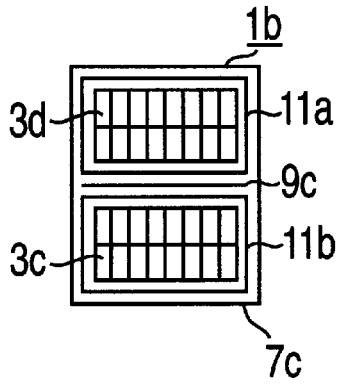
FIG. 3 shows a further conductor in the cross-section along the line III—III of FIG. 1.

The cross-section shown in FIG. 3 illustrates a preferred embodiment of the conductor 1 from FIG. 1. The conductor denoted by 1*b* has two conductor portions 3*c* and 3*d* surrounded, in each case, by a separate insulation 11*a*, 11*b*. The conductor portions 3*c* and 3*d* are, as indicated in the drawing, constructed as interlinked twin transposed conductors. A capacitance-determining separator 9*c* is arranged between the conductor portions 3*c* and 3*d*. The conductor portions 3*c*, 3*d* are surrounded by a common insulation 7*c*. In this embodiment, the common insulation can, if necessary, be designed thinner than in the embodiment shown in FIG. 1. A function of the common insulation 7*c* is to hold the respective conductor portions together or to join them to one another.

Dispensing with the edge protection rings, which have been used in the past for electrical reasons (e.g., for impulse insulation level), is possible due to the common insulation 7*a* to 7*d*.

Figure 4:
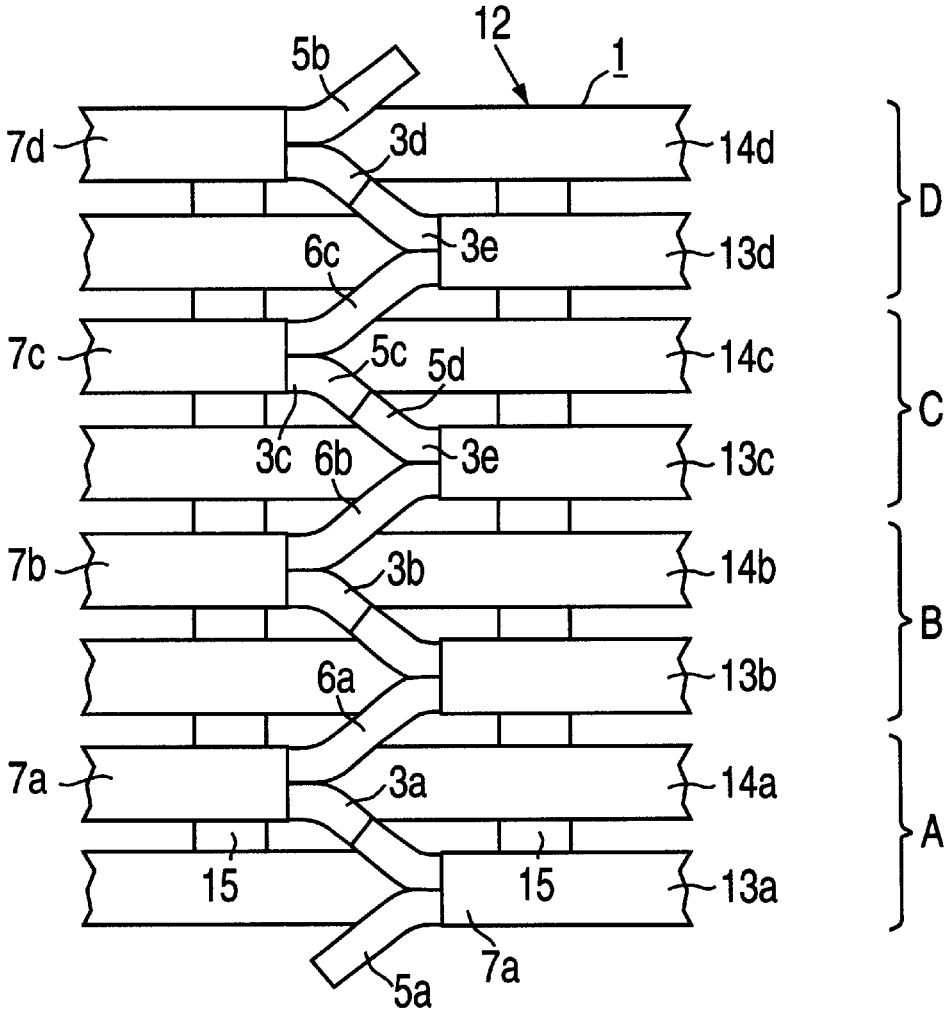
FIG. 4 shows a partial external view of a winding arrangement.

FIG. 4 shows a partial external view of a winding arrangement 12 which uses the conductor 1 shown in FIG. 1. In FIG. 4, the winding arrangement 12 is constructed as a coil with a continuous turned-over (i.e., continuously wound) winding. In this arrangement, the conductor sections A, B, C and D respectively form disk coil pairs 13*a*, 14*a* to 13*d*, 14*d*. The free ends 5*a*, 5*b* of the end-side disk coils 13*a* and 14*d*, respectively, form the terminals for the winding arrangement 12. The individual disk coils 13*a* to 14*d* are separated from one another by spacer inserts 15.

In the partial external view shown, the region of the winding arrangement 12 is shown at which the joints between the conductor portions 3*a* to 3*e* are produced. By way of example for the entire winding arrangement 12, the free ends 5*c*, 5*d* of the conductor portions 3*c* and 3*d* are connected to form a joint between the two disk coils 13*c* and 14*c* of the conductor section C. The transitions 6*a* to 6*c*, which are formed, in each case, by the conductor portions 3*b* to 3*d*, lie between the respective disk coils of two adjacent conductor sections. For example, the transition 6*c* lies between the conductor sections D and C with the disk coils 13*d* and 14*c*. A further joint between the adjacent disk coils is situated (not represented in more detail), as is customary in continuous turn-over windings, on the inside of the winding arrangement 12. Such a transition point corresponds in FIG. 1 to the respective centers of the conductor sections A to D.

If, by way of example, a conductor in accordance with FIG. 1 is processed on a winding form to produce a winding arrangement 12 in accordance with FIG. 4, substantial advantages in fabrication can be achieved. Despite the increased outlay in the production of the conductor 1, savings are achieved in the total winding arrangement 12. This relates, in particular, to application of disk coils and of continuous turn-over windings. Despite much reservation in expert circles with regard to manipulability, it has been found that the use of the proposed prefabricated conductor 1 is particularly favorable, in particular in large winding arrangements, for example for high-voltage transformers. In addition, the following advantages have further emerged from trials with the method indicated:

Shielding angles on the inside of winding arrangements or of coils for transformers can be eliminated without replacement.

Up to four normal double coils can be wound from twin transposed conductors.

The free ends 5*c*, 5*d*, which are to be electrically connected to one another, are always situated in the correct position after winding of the coil.

Capacitance-determining inserts can already be contained in the prefabricated conductor. The steps of punching and inserting radial shims during the winding of the winding arrangement is eliminated.

If required, it is also possible to prefabricate only one input group of a winding arrangement or a few groups.

The elimination of shielding angles produces a lower hot-spot temperature in the winding arrangement.

In the application of the present invention in the high-voltage range, the separators 9*a* to 9*b* are preferably used at thicknesses of between 0.1 to 2 mm, in particular 0.3 to 1 mm. Voltage stresses of between 50 to 150 KV are taken into account in this case.

Method for Producing a Winding Arrangement of a Coil

The invention relates to a method for producing a winding arrangement of a coil, and to an electric conductor for this purpose and a winding arrangement produced according to the method.

It is known for the purpose of producing a coil, for example a coil for a transformer, to wind an electric conductor onto a coil form. With regard to wired-up winding arrangements, it is necessary in this case to wind individual part windings successively, which are then subsequently wired up to one another. A special case in this regard is the so-called continuous turn-over winding. It is very expensive to produce a coil having such a winding.

DE-A1-3,214,171 shows such a winding arrangement. The conductor used there comprises subconductors which are connected in parallel and in series. No further details are given on the production of the winding.

The object of the invention is to specify a method by means of which the production of a coil can be simplified. A further object is to provide an electric conductor for such a method and to specify the winding arrangement produced according to the method.

The object is achieved by means of a method in accordance with the features of claim 1. A substantial time saving is achieved in this way in the production of a coil. Winding the coil can be performed substantially more quickly in this case than heretofore. This holds, in particular when a conductor is used in which additional measures have already been taken which were previously carried out during the winding operation. This relates, for example, to the insertion of separators for an insulation between windings or an edge protector. The method is also suitable for expensively interleaved windings.

It is favorable if at least a part of the conductor is wound onto the winding form with the formation of a disk winding.

If the latter are connected to one another, the conductor 1 is electrically conducted along the conductor sections B, C and D. Transitions between the conductor sections A to D are denoted by the reference symbols 6*a*, 6*b*, 6*c*. The free ends 5*a*, 5*b* of the end-side conductor portions 3*a*, 3*e* form the terminals for the external terminal of the later winding arrangement. It is also possible for more than two conductor portions to be arranged in parallel in a section.

The cross-section, shown in FIG. 2, of the conductor 1 from FIG. 1 along the line II—II represents a simple variant embodiment. The conductor denoted by 1*a* has two conductor portions 3*c*, 3*d*, which are mutually insulated by the separator 9*c*. The conductor portions 3*c*, 3*d* are surrounded by a common insulation 7*c*. The conductor portions 3*c*, 3*d* can in this case comprise one or more conductor cores, for example as a solid conductor or a transposed conductor. This embodiment is particularly space saving, since it is possible therefrom to produce a very closely and compactly wound coil which has very small boundary dimensions.

The cross-section shown in FIG. 3 shows a preferred variant of the conductor 1 from FIG. 1. The conductor denoted by 1*b* has two conductor portions 3*c* and 3*d* surrounded in each case by a separate insulation 11*a*, 11*b*. Said portions are, as indicated in the drawing, constructed as interlinked twin transposed conductors. Arranged between them is a separator 9*c* which is constructed so as to be capacitance-determining. The conductor portions 3*c*, 3*d* are surrounded by a common insulation 7*c*. In the case of the present design, the latter can, is necessary, be designed thinner than in the case of the design in accordance with FIG. 1. A function of the common insulation 7*c* is to hold the respective conductor portions together or to join them to one another. What is fundamental here is that because of the common insulation 7*a* to 7*d* (FIG. 1) it is possible to dispense with the edge protection rings which have been used in the prior art to date for electrical reasons (impulse insulation level).

What is claimed is:

1. An electrical conductor arrangement to provide a plurality of disc coils, comprising:

a first conductor portion, a second conductor portion, and a third conductor portion, the first conductor portion, the second conductor portion and the third conductor portion being positioned in side-by-side orientation with respect to one another and electrically insulated from one another, the first conductor portion being disposed between the second conductor portion and the third conductor portion, the first conductor portion including a first longitudinal section and a second longitudinal section, each of the first longitudinal section and the second longitudinal section extending in a longitudinal direction, the second conductor portion being mechanically connected to the first conductor portion along a length of the first longitudinal section of the first conductor portion, the second conductor portion extending next to the first longitudinal section of the first conductor portion, the third conductor portion being mechanically connected to the first conductor portion along a length of the second longitudinal section of the first conductor portion, the third conductor portion extending next to the second longitudinal section of the first conductor portion and both the second conductor portion and the third conductor portion extending in a region of transition from the first longitudinal section to the second longitudinal section of the first conductor portion.

2. The electrical conductor arrangement according to claim 1, further comprising:

a first electrical insulator arranged between the first conductor portion and the second conductor portion; and a second electrical insulator arranged between the first conductor portion and the third conductor portion.

3. The electrical conductor arrangement according to claim 1, first comprising:

a first common electrical insulator surrounding and mechanically joining the first longitudinal section of the first conductor portion and the second conductor portion; and a second common electrical insulator surrounding and mechanically joining the second longitudinal section of the first conductor portion and the third conductor portion.

4. The electrical conductor arrangement according to claim 1, wherein each of the first conductor portion, the second conductor portion and the third conductor portion includes a plurality of conductor cores.

5. The electrical conductor arrangement according to claim 1, wherein the first conductor portion, the second conductor portion and the third conductor portion are transposed conductors.

6. The electrical conductor arrangement according to claim 1, further comprising:

an electrically insulated capacitive control conductor arranged between the first conductor portion, the second conductor portion and the third conductor portion.

7. The electrical conductor arrangement according to claim 1, wherein the first conductor portion, the second conductor portion and the third conductor portion are in a step-type arrangement.

* * * * *